US007301084B2

(12) United States Patent
Okada

(10) Patent No.: US 7,301,084 B2
(45) Date of Patent: Nov. 27, 2007

(54) UPRIGHT KEYBOARD MUSICAL INSTRUMENT

(75) Inventor: Keita Okada, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 173 days.

(21) Appl. No.: 11/090,578

(22) Filed: Mar. 25, 2005

(65) Prior Publication Data

US 2005/0217454 A1 Oct. 6, 2005

(30) Foreign Application Priority Data

Mar. 30, 2004 (JP) ..... 2004-097533

(51) Int. Cl.
*G10C 3/02* (2006.01)

(52) U.S. Cl. ..... 84/177; 84/172

(58) Field of Classification Search ..... 84/177, 84/172; D17/8; 220/4.22, 4.23
See application file for complete search history.

(56) References Cited

U.S. PATENT DOCUMENTS 3,969,970 A * 7/1976 Swift et al. ..... 84/177

5,818,360 A * 10/1998 Chu et al. ..... 341/22

FOREIGN PATENT DOCUMENTS

JP 11-305761 11/1999

* cited by examiner

*Primary Examiner*—Lincoln Donovan
*Assistant Examiner*—Jianchun Qin
(74) *Attorney, Agent, or Firm*—Koda & Androlia

(57) ABSTRACT

An upright keyboard musical instrument has an open/close board attached to the top position of a case, wherein the lower surface of the open/close board is subjected to mirror surface finishing and is supported by a lid prop, which is rotatably arranged in proximity to the top board to rotate about a support axis and is formed in an L-shape to have a plurality of support surfaces, realizing different angles for the open/close board being opened. The mirror surface of the open/close board projects images representing internal members of the case, such as an emblem and actions. By appropriately rotating the lid prop, it is possible to realize a desired angle for the open/close board, thus realizing tone volume control and visually entertaining effects in musical performance.

9 Claims, 4 Drawing Sheets

UPRIGHT KEYBOARD MUSICAL INSTRUMENT

BACKGROUND OF THE INVENTION

1. Field of the Invention

This invention relates to upright keyboard musical instruments such as upright pianos, which are equipped with top boards having opening and closing functions.

This application claims priority on Japanese Patent Application No. 2004-97533, the content of which is incorporated herein by reference.

2. Description of the Related Art

Conventionally, keyboard musical instruments such as grand pianos and upright pianos are equipped with top boards, which are attached to top positions of main bodies and are free to be opened or closed. During musical performance, top boards are appropriately opened so that musical tones are emitted to the outside of the cases and are thus increased in tone volume. Japanese Patent Application Publication No. H11-305761 discloses an example of a keyboard musical instrument, which is equipped with a support rod for supporting the lower portion of a top board to be opened, and a buffer device for preventing the top board from rapidly rotating when it is closed. Conventionally known keyboard musical instruments control tone volumes by opening and closing top boards, wherein they prevent user's fingers from being caught between cases and top boards, which are opened or closed.

Conventionally known keyboard musical instruments (particularly, upright pianos) allow top boards to be opened or closed only for the purpose of tone volume control. When users play keyboard musical instruments such as grand pianos with top boards in the open condition, for example, they can directly view movements of hammers included in actions, which demonstrate entertaining effects in musical performance. In contrast to grand pianos, upright pianos cannot demonstrate such entertaining effects in musical performance.

SUMMARY OF THE INVENTION

It is an object of the invention to provide an upright keyboard musical instrument that demonstrates visual effects regarding musical performance in addition to tone volume control in an open condition of a top board.

An upright keyboard musical instrument of this invention includes an opening and closing board, namely, an open/close board attached to the top position of a case, whose lower surface forms a mirror for reflecting an image of an internal member of the case; and a lid prop for supporting the open/close board to be opened with a prescribed angle therewith (e.g., 15° and 40°). The lid prop is rotatably arranged in proximity to the open/close board so as to rotate about a support axis to realize the prescribed angle therewith.

The lid prop has at least one support surface that is formed normal to the support axis so as to support the open/close board with the prescribed angle therewith. Specifically, the lid prop is formed in an L-shape or in a pentagonal shape to have a plurality of support surfaces, which are each formed normal to the support axis to have different lengths measured with respect to the support axis, thus realizing different angles with respect to the open/close board. By appropriately rotating the lid prop, it is possible to realize a desired angle between the open/close board and the upper end of the case, whereby the mirror surface of the open/close board can project images representing internal members of the case, such as an emblem and actions, and it is possible to realize tone volume control and visually entertaining effects in musical performance.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

1. First Embodiment

Figure 1:
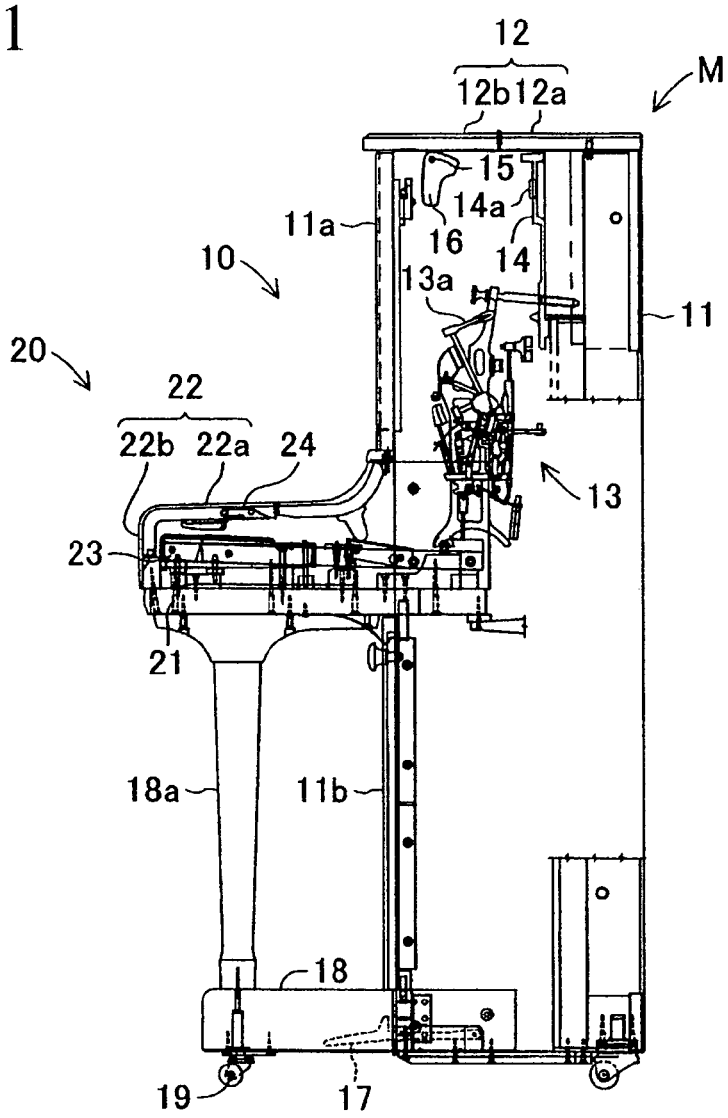
FIG. 1 is a side view partly in cross section showing an upright keyboard musical instrument having a top board, a keyboard, and a case including actions in accordance with a first embodiment of the invention.

FIG. 1 is a side view showing an upright keyboard musical instrument M in accordance with a first embodiment of the invention, wherein the upright keyboard musical instrument M is constituted by a main body 10 and a keyboard assembly 20 that projects forwards from the main body 10. The outline of the main body 10 is constituted by a case 11 having a rectangular box-like shape, and the outline of the keyboard assembly 20 is constituted by a keyboard casing having a rectangular box-like shape, which projects forwards from the center portion of the case 11 vertically standing. The upper portion of the main body 10 is covered with a top board 12, which can be freely opened or closed. The upper portion of the keyboard assembly 20 is covered with a fall board 22 that can be freely opened or closed.

A keyboard 23 having a plurality of white keys and black keys is arranged inside of the keyboard casing 21. The case 11 includes a plurality of actions 13, which are interlocked with the keys of the keyboard 23 and are respectively driven upon depression of the keys, and a plurality of strings (not shown) that are struck by hammers 13*a* included in the actions 13. In addition, a sound board (not shown) is arranged for the case 11. A frame 14 is attached to the upper end of a rear portion inside of the case 11; and an emblem 14*a* is attached to the center portion of a front surface of the frame 14.

The top board 12 is constituted by a top board rear 12*a*, which is fixed to the case 11, and an open/close board 12*b*, which is hinged to the front end of the top board rear 12*a* and can be freely opened or closed. The lower surface of the open/close board 12*b* is subjected to mirror surface finishing and is thus capable of visually showing images of objects. A lid prop 16 (which forms a rotation support member of the present invention) is arranged in proximity to the center portion of the open/close board 12*b* lying in front-back directions, relative to one side of the case 11, wherein the lid prop 16 rotates about a support axis 15 whose axial line is directed horizontally.

Figure 2:
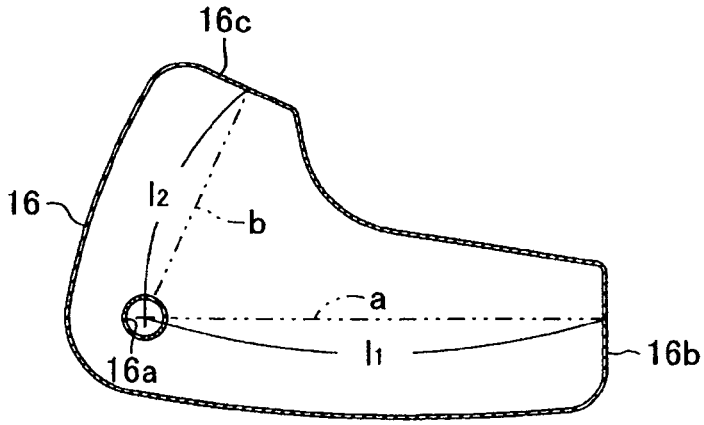
FIG. 2 is a side view partly in cross section showing a lid prop that is installed in the upright keyboard musical instrument in proximity to an open/close board of the top board.

As shown in FIG. 2, the lid prop 16 is entirely constituted by a board member roughly having an L-shape in side view, wherein a hole 16*a* is formed at a prescribed position close to the corner of the L-shape. Support surfaces 16*b* and 16*c* realized by flat surfaces are formed at both ends of the L-shape. The overall shape of the L-shaped lid prop 16 is defined by lengths 11 and 12, which are respectively measured using line segments 'a' and 'b', wherein the line segment 'a' extends from the center point of the hole 16*a* to rectangularly cross the support surface 16*b*, and the line segment 'b' extends from the center point of the hole 16*a* to rectangularly cross the support surface 16*c*. The length 11 lies between the center point of the hole 16*a* and an intersecting point at which the line segment 'a' rectangularly intersects with the support surface 16*b*; and the length 12 lies between the center point of the hole 16*a* and an intersecting point at which the line segment 'b' rectangularly intersects with the support surface 16*c*. Herein, the length 11 is approximately two times longer than the length 12. In addition, an angle formed between the line segments 'a' and 'b' is approximately set to 60°.

Corner portions of the support surface 16*b* are curved in such a way that as shown in FIG. 2, the radius of curvature of the lower corner is set to be greater than the radius of curvature of the upper corner, whereby the lower corner is smoothly curved. The upper corner of the support surface 16*b* is formed to be aligned with the extension of the support surface 16*c*. Similarly, corner portions of the support surface 16*c* are curved in such a way that as shown in FIG. 2, the radius of curvature of the left corner is set to be greater than the radius of curvature of the right corner, whereby the left corner is smoothly curved.

Figure 3:
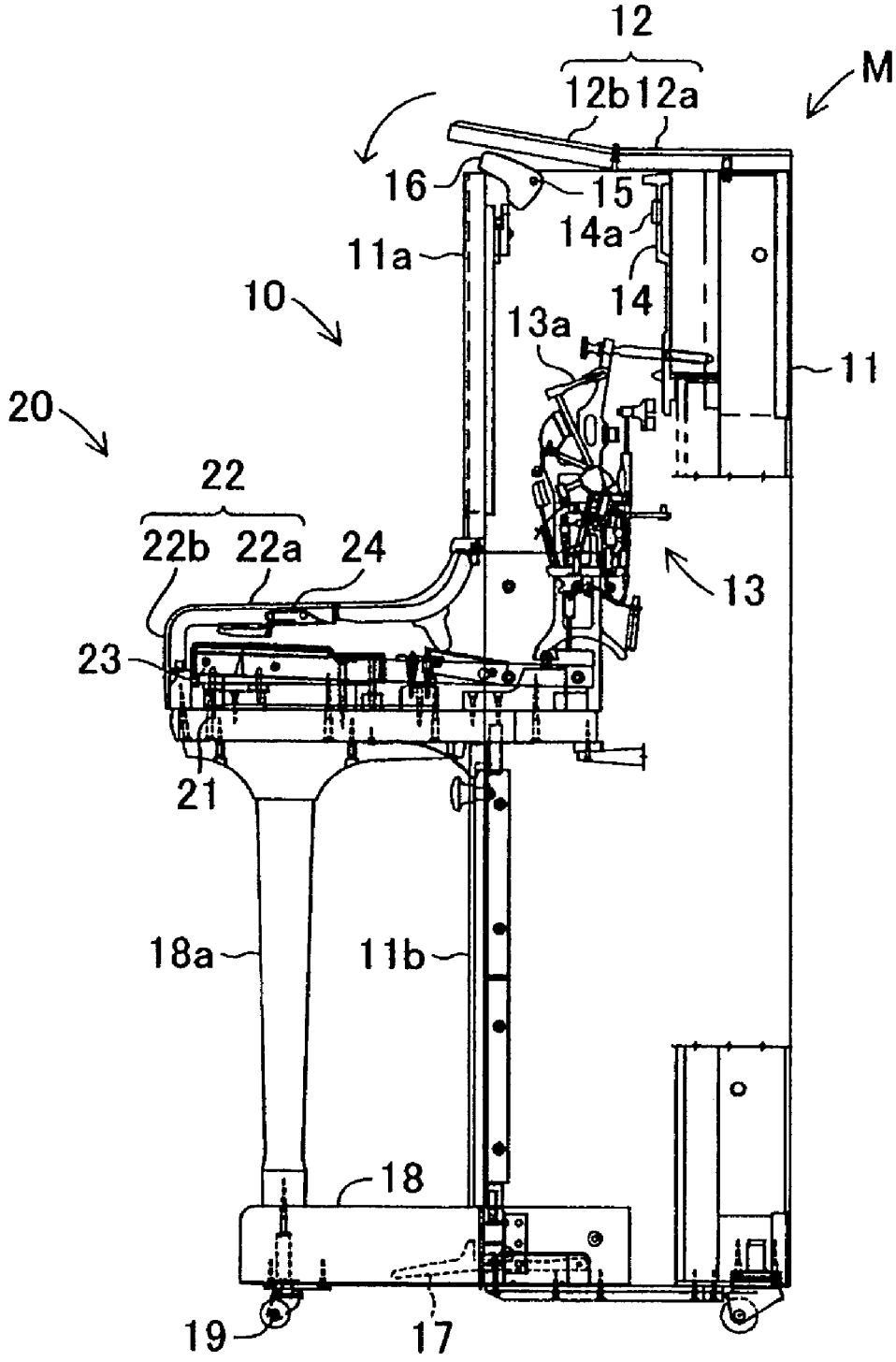
FIG. 3 is a side view partly in cross section showing the upright keyboard musical instrument in which the open/close board is slightly opened and is stopped by the lid prop so as to prevent fingers from being caught between the open/close board and the upper end of the case.

The support axis 15 is fixed at a prescribed position at which the shortest length between the center of the support axis 15 and the interior wall of an upper front portion 11*a* of the case 11 becomes shorter than the shortest length between the center of the support axis 15 and the support surface 16*b*, which is identical to the length 11. Therefore, when the open/close board 12*b* is gradually opened in the initial state shown in FIG. 1 so tat the lid prop 16 rotates in a counterclockwise direction, the open/close board 12*b* is finally opened as shown in FIG. 3 in which the support surface 16*b* of the lid prop 16 comes in contact with the upper end of the upper front portion 11*a* so that the lid prop 16 is stopped and cannot be rotated further. In this state, the open/close board 12*b* cannot move downward below the position of the lid prop 16, whereby a gap is maintained between the open/close board 12*b* and the upper end of the upper front portion 11*a*.

A pedal assembly 17 including three pedals (only one of which is illustrated for the sake of convenience) is attached to the center of the lower end of a lower front portion 11*b* of the case 11. Support bases 18 for supporting the keyboard assembly 20 project forwards from both ends of the lower end of the lower front portion 11*b*. Legs 18*a* are arranged between the upper surfaces of the front portions of the support bases 18 and both ends of the lower surfaces of the keyboard casing 21. Thus, it is possible to support the keyboard assembly 20. In addition, wheels 19 are attached to the rear positions of the lower surface of the case 11 and the front positions of the lower surfaces of the support bases 18, thus allowing the upright keyboard musical instrument M to move.

Figure 4:
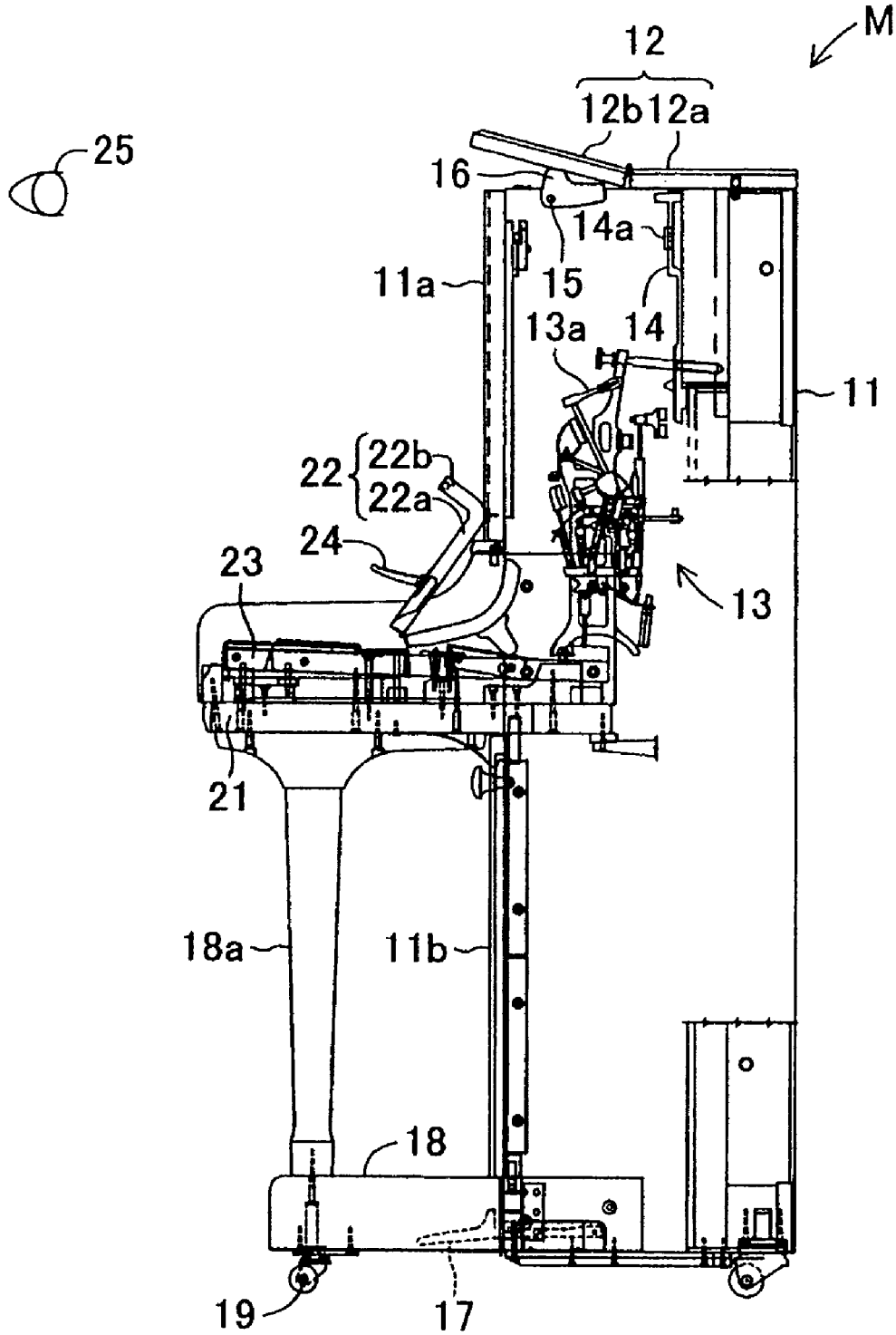
FIG. 4 is a side view partly in cross section showing the upright keyboard musical instrument in which the open/close board is opened with a relatively small angle so as to produce musical tones with relatively large tone volumes.
Figure 5:
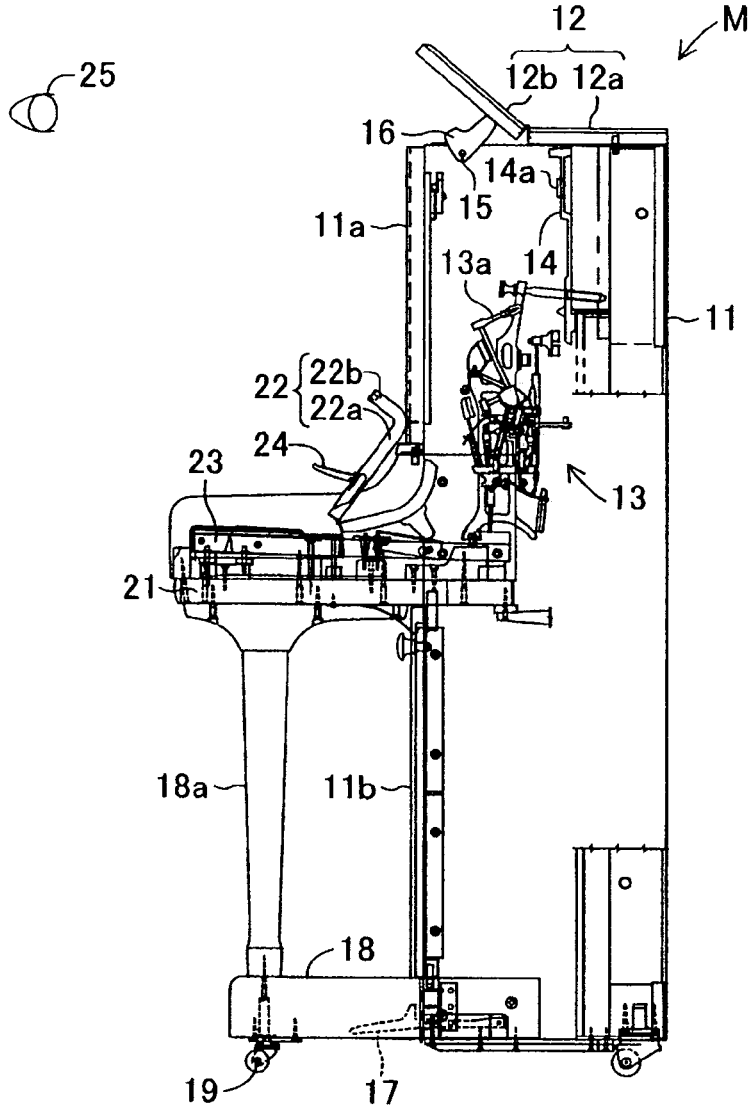
FIG. 5 is a side view partly in cross section showing the upright keyboard musical instrument in which the open/close board is further opened with a relatively large angle so as to produce musical tones with loudness.

The fall board 22 of the keyboard assembly 20 is formed as an open/close cover having an L-shape in cross section, which is constituted by an upper portion 22*a* and a front portion 22*b*. A music stand 24 for mounting a musical score thereon is attached to the lower surface of the upper portion 22*a* of the fall board 22. The music stand 24 is hinged to the lower surface of the upper portion 22*a*. When the fall board 22 is closed, the music stand 24 is folded to lie along the lower surface of the upper portion 22*a*. When the fall board 22 is opened so that a musical score is mounted on the music stand 24, as shown in FIGS. 4 and 5, the music stand 24 is folded down to project forwards from the upper portion 22*a* of the fall board 22 that is opened. Thus, the music stand 24 is roughly maintained in a horizontal state, which allows a musical score to be mounted thereon.

Next, a description will be given with respect to musical performance using the upright keyboard musical instrument M.

First, the fall board 22 is opened, and the music stand 24 is folded down as necessary so that a musical score may be placed thereon. When the user plays the upright keyboard musical instrument M to produce small tone volumes, the user plays the keyboard 23 in the closed state of the top board 12. Thus, the upright keyboard musical instrument M gently produces musical tones with relatively small tone volumes.

In order to emit musical tones to the surrounding space with relatively large tone volumes, the front end of the open/close board 12*b* is slightly lifted up so as to allow the lid prop 16 to rotate in the counterclockwise direction in FIG. 1, wherein as shown in FIG. 4, the support surface 16*c* is directed upwards. In this state, the open/close board 12*b* is slightly lowered and is thus supported by the lid prop 16. Thus, it is possible to maintain the open/close board 12*b* being opened with a relatively small angle as shown in FIG. 4.

In FIG. 4, the lower surface of the open/close board 12*b* comes in contact with the overall area of the support surface 16*c* and the upper corner of the support surface 16*b*, wherein the line segment b connecting between the support surface 16*c* and the support axis 15 crosses at a right angle with the lower surface of the open/close board 12*b*, which is maintained in a stable manner. In this state, the user (or player) can view the emblem 14*a* attached to the frame 14 via the lower surface of the open/close board 12*b* with eyes 25, which are positioned as shown in FIG. 4. This makes it possible for the user to play the upright keyboard musical instrument M while viewing the emblem 14*a*. Herein, the upright keyboard musical instrument M can produce and emit slightly louder musical tones into the surrounding space thereof.

In order to produce and emit further louder musical tones into the surrounding space, the front end of the open/close board 12*b* is lifted up again so as to allow the lid prop 16 to further rotate in the counterclockwise direction in FIG. 4, whereby the support surface 16*b* is directed upwards. In this state, the open/close board 12*b* is slightly lowered down and is thus supported by the lid prop 16. Herein, the open/close board 12*b* is opened with a relatively great angle as shown in FIG. 5.

In FIG. 5, the overall area of the support surface 16*b* of the lid prop 16 comes in contact with the lower surface of the open/close board 12*b*, wherein the line segment a connecting between the support surface 16*b* and the support axis 15 crosses at a right angle with the lower surface of the open/close board 12*b*, which is maintained in a stable manner. In this state, the user can view the actions 13 via the lower surface of the open/close board 12*b* with eyes 25, which are positioned as shown in FIG. 5. Herein, the user visually feels as if the actions 13 are horizontally arranged. Hence, the user can play the upright keyboard musical instrument M while viewing the movements of the actions 13 with sensations that the user plays a grand piano. The upright keyboard musical instrument M can produce and emit powerful loud musical tones into the surrounding space.

After the completion of the musical performance, the front end of the open/close board 12*b* is slightly lifted up so as to allow the lid prop 16 to rotate in the clockwise direction in FIG. 5, whereby the support surface 16*b* is directed downwards. Then, the open/close board 12*b* is lowered down and closed. When the user slips hand in operating the open/close board 12*b* so that the open/close board 12*b* falls down due to its own weight, the lid prop 16 further rotates in the counterclockwise direction in FIG. 5, the lid prop 16 is brought into contact with the upper end of the upper front portion 11*a* of the case and is thus stopped in movement, wherein the open/close board 12*b* is stopped just above the lid prop 16 as shown in FIG. 3.

This mechanism reliably prevent user's fingers from being caught between the open/close board 12*b* and the upper end of the upper front portion 11*a* of the case 11, so that the user would not be injured. When the lid prop 16 rotates in the clockwise direction in FIG. 5, the lid prop 16 and the open/close board 12*b* are stopped as shown in FIG. 4. That is, even when the lid prop 16 rotates in both of the clockwise direction and counterclockwise direction, it is possible to reliably prevent user' fingers from being caught between the open/close board 12*b* and the upper end of the upper front portion 11*a* of the case 11, so that the user would not be injured.

The upright keyboard musical instrument M uses the open/close board 12*b* whose lower surface is subjected to mirror surface finishing, wherein when the open/close board 12*b* is opened, the user can view the emblem 14*a* of the main body 10 or the actions 13 in response to the open angle of the open/close board 12*b*. Therefore, the user can play the upright keyboard musical instrument M while viewing the emblem 14*a*; and the user can play it while viewing the actions 13 with sensations as if the user plays a grand piano. In addition, tone volumes of musical tones produced by the upright keyboard musical instrument M can be controlled by appropriately opening or closing the open/close board 12*b*. The present embodiment is advantageous in that the open/close board 12*b* can be freely opened or closed with simple operation by rotating the lid prop 16, which is realized by slightly lifting up the open/close board 12*b*.

2. Second Embodiment

Figure 6:
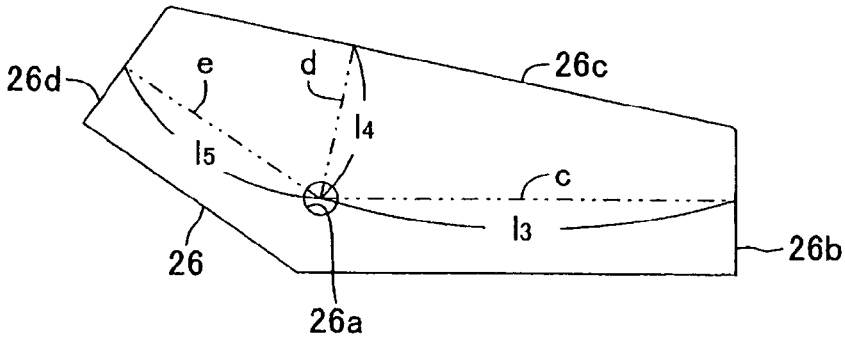
FIG. 6 is a side view showing a lid prop installed in an upright keyboard musical instrument in accordance with a second embodiment of the invention.

FIG. 6 shows a lid prop 26 installed in an upright keyboard musical instrument in accordance with a second embodiment of the invention. The lid prop 26 is formed by a pentagonal board that is horizontally elongated in side view and is constituted by three sections, namely, 'planar' support surfaces 26*b*, 26*c*, and 26*d*, which are defined using different lengths 13, 14, and 15 designated by line segments 'c', 'd', and 'e' measured with respect to a hole 26*a*.

The line segment 'c' is elongated from the center point of the hole 26*a* and rectangularly crosses the support surface 26*b* so as to define the length 13; the line segment 'd' is elongated from the center point of the hole 26*a* and rectangularly crosses the support surface 26*c* so as to define the length 14; and the line segment 'e' is elongated from the center point of the hole 26*a* and rectangularly crosses the support surface 26*d* so as to define the length 15. Herein, the length 13 is approximately three times longer than the length 14; and the length 15 is approximately a half of the length 13. In addition, an angle formed between the line segments c and d is set to 80°; and an angle formed between the line segments d and e is set to 70°.

Other parts of the upright keyboard musical instrument equipped with the lid prop 26 are identical to those of the upright keyboard musical instrument M of the first embodiment. The upright keyboard musical instrument is capable of changing the open angle of the open/close board 12*b* by three steps, which guarantees an appropriate condition for viewing internal members of the main body via the open/close board 12*b*, regardless of changes of positions of user's eyes 25, which vary according to user's physical dimensions. Effects and operations of the upright keyboard musical instrument of the second embodiment are similar to those of the upright keyboard musical instrument M of the first embodiment.

The upright keyboard musical instrument according to this invention is not necessarily limited to the aforementioned embodiments; hence, it can be modified in a variety of ways, which will be described below.

In the aforementioned embodiments, the lower surface of the open/close board 12*b* is subjected to mirror surface finishing so that the user can view internal members of the main body 10. Instead, it is possible to adhere a mirror to the lower surface of the open/close board 12*b*, wherein the mirror can be adhered only to the center area of the lower surface of the open/close board 12*b*.

When the lower surface of the open/close board 12*b* is subjected to mirror surface finishing, the open/close board 12*b* is composed of a wood material so that the lower surface thereof is coated with a film, which is then subjected to mirror surface finishing. Alternatively, the open/close board 12*b* is composed of material other than a wood material so that the lower surface thereof is subjected to mirror surface finishing. The member for supporting the open/close board 12*b* is not necessarily limited to the lid props 16 and 26 and can be appropriately formed in other shapes. For example, the lid prop can be shaped to have a single support surface or shaped to have three or more support surfaces. In addition, the member for supporting the open/close board 12*b* is not necessarily limited to the lid props 16 and 26 that are rotatably installed below the open/close board 12*b*. That is, it is possible to use rod-like members for supporting the open/close board 12*b*.

FIG. 3 shows the condition for preventing user's fingers from being caught between the upper end of the upper front portion 11*a* of the case 11 and the open/close board 12*b* that may be accidentally folded down. This condition can be used for one step for controlling the open angle of the open/close board 12*b*. This realizes the upright keyboard musical instrument M equipped with the lid prop 16 to be controlled in the open angle of the open/close board 12*b* in three steps. Similarly, this realizes the upright keyboard musical instrument equipped with the lid prop 26 to be controlled in the open angle of the open/close board 12*b* in four steps. Thus, it is possible to increase the number of steps for controlling the open angle of the open/close board 12*b*. Hence, it is possible to change internal members to be visually projected on the mirror by appropriately changing the angle of the open/close board 12*b*; and it is possible to change the tone volume and tome color as necessarily.

In addition, it is possible to change the size of the open/close board 12*b* of the top board 12 so as to adequately broaden the area of the mirror for visually projecting internal members of the case 11. In the aforementioned embodiments, the emblem 14*a* is attached to the frame 14, however, which can be decorated using other members. For example, it is possible to decorate the frame 14 by use of precious members representing brightness of stars and jewels or by use of pictorial patterns. This may realize visual entertainments in playing musical performance. Of course, this invention is not necessarily limited to 'acoustic' upright keyboard musical instruments but is applicable to 'electronic' upright keyboard musical instruments.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. An upright piano keyboard musical instrument comprising:

an open/close board, attached to a top position of a case, whose lower surface forms a mirror for reflecting an image of an internal member of the case, thus allowing a person to visually recognize the image of the internal member of the case from its front side when the open/close board is opened;

a lid prop for supporting the open/close board to be opened with a prescribed angle therewith; and wherein the lid prop has at least one support surface that is formed normal to the support axis so as to support the open/close board with the prescribed angle therewith; and the lid prop has a plurality of support surfaces that are each formed normal to the support axis to have different lengths measured with respect to the support axis, thus realizing different angles with respect to the open/close board.

2. An upright keyboard musical instrument according to claim 1, wherein the lid prop has an L-shape in side view.

3. An upright keyboard musical instrument according to claim 1, wherein the top board has a pentagonal shape in side view.

4. An upright piano keyboard musical instrument having a top board having opening and closing functions on a top position of a case, comprising:

an open/close board included in the top board, wherein an upper surface of the open/close board forms a part of an exterior and a lower surface having a mirror function for reflecting an image of an interior of said case, thus allowing a person to visually recognize the image of the internal member of the case from its front side when the open/close board is opened; and a support member for maintaining the open/close board to be opened with a prescribed angle measured from an upper end of the case, wherein the support member is constituted by a support axis, which is arranged inside of the case and is extended in a horizontal direction of the top board, and a lid prop that is arranged to rotate about the support axis, and wherein the lid prop is constituted by a polygonal board having a plurality of support surfaces, which are normal to the support axis so as to support the lower surface of the open/close board and which differ from each other in length measured from the support axis.

5. An upright keyboard musical instrument according to claim 4, wherein the support member has at least two support surfaces, each of which has a prescribed length that is measured from the support axis and is longer than a distance between the support axis and the upper end of the case.

6. An upright keyboard musical instrument according to claim 4, wherein the open/close board is supported by the support member so that the open/close board is maintained at the prescribed angle allowing an image of an internal member of the case to be reflected on the lower surface of the open/close board.

7. An upright keyboard musical instrument according to claim 4, wherein the prescribed angle is set to 15° or 40°.

8. An upright keyboard musical instrument according to claim 4, wherein the open/close board is opened and is supported by the support member whose support surface is brought into contact with the lower surface of the open/close board.

9. An upright keyboard musical instrument according to claim 4, wherein the support member has at least one support surface whose length measured from the support axis is longer than a distance between the support axis and the upper end of the case.

* * * * *